United States Patent [19]

Sybertz

[11] 4,220,186

[45] Sep. 2, 1980

[54] ARRANGEMENT FOR MOUNTING A CUTTING BLADE, PARTICULARLY ON A ROTOR OF A WOOD-CHIPPING MACHINE

[75] Inventor: Hans Sybertz, Hargesheim, Fed. Rep. of Germany

[73] Assignee: Hombak Maschinenfabrik KG, Bad Kreuznach, Fed. Rep. of Germany

[21] Appl. No.: 918,141

[22] Filed: Jun. 22, 1978

[30] Foreign Application Priority Data

Jul. 4, 1977 [DE] Fed. Rep. of Germany ..... 2730107
Sep. 3, 1977 [DE] Fed. Rep. of Germany ..... 2739749

[51] Int. Cl.[2] ..... B27G 13/00
[52] U.S. Cl. ..... 144/230; 144/174
[58] Field of Search ..... 144/116 R, 172, 174, 144/176, 218, 230

[56] References Cited

U.S. PATENT DOCUMENTS

| | | | |
|---|---|---|---|
| 3,865,164 | 2/1975 | Sybertz | 144/230 |
| 3,913,645 | 10/1975 | Maier | 144/230 |
| 3,957,094 | 5/1976 | Maier | 144/230 |
| 4,068,694 | 1/1978 | Schmidt et al. | 144/218 X |

FOREIGN PATENT DOCUMENTS

| | | | |
|---|---|---|---|
| 2405000 | 8/1975 | Fed. Rep. of Germany | 144/230 |

*Primary Examiner*—W. Donald Bray
*Attorney, Agent, or Firm*—Michael J. Striker

[57] ABSTRACT

A cutting blade is mounted on a support by being clamped between a supporting portion of the support and a pressing portion of a pressing lever which is mounted on the support for pivoting about an axis which extends parallel to the elongation of the cutting blade and has an actuating portion which is acted upon by at least one actuator which urges the pressing lever towards its clamping position. A resilient mounting portion is connected to the support and to the pressing lever and mounts the pressing lever for the abovementioned pivoting. The mounting portion has enlarged foot and connecting zones which are respectively received and held in respective compatible recesses of the support and of the pressing lever, preferably in undercut grooves thereof. A part of the support, the pressing lever, the mounting portion and the actuator may constitute a unit which is interchangeably mounted on the remainder of the support. Additional such units may also be provided, being arranged adjacent and with spacing from the abovementioned unit and constituting the outer periphery of a cutting tool which may be mounted for rotation about an axis parallel to the elongation of the respective cutting blades.

35 Claims, 6 Drawing Figures

ARRANGEMENT FOR MOUNTING A CUTTING BLADE, PARTICULARLY ON A ROTOR OF A WOOD-CHIPPING MACHINE

BACKGROUND OF THE INVENTION

The present invention relates to material-removing tools in general, and more particularly to such tools which may be used in wood-chipping machines, such as wood-machining or wood-shredding machines.

There are already known various constructions of tools and machines of the type here under consideration. So, for instance, there is already known a wood-chipping machine which has a rotatable wood-chipping tool equipped with a plurality of cutting blades which are held, at least in the radial direction, exclusively by frictional forces, by resorting to the use, in each instance, of a two-armed lever which is acted upon by a respective actuator or a plurality of actuators, the axis of pivoting of this two-armed lever extending parallel to the axis of rotation of the wood-chipping tool or to the elongation of the cutting blades. In this arrangement, one of the arms of the two-armed lever immediately or mediately acts on the cutting blade, while the other arm of the two-armed lever is acted upon by the actuator or actuators.

An arrangement of this type has been revealed in the German published patent No. 7,234,178. This publication discloses a rotating tool for wood-chipping machines which includes a plurality of cutting blades which are held on the body of the tool by clamping elements that are arranged behind the respective cutting blades as considered in the direction of the rotation of the tool. The clamping elements include a clamping slide which is guided on the body of the tool for free movement in an approximately radial direction and which has parallel lateral edges, the clamping slide pressing radially outwardly against a clamping lever which is mounted in the body of the tool for pivoting about a pivot axis. The clamping lever has an exposed surface which is flush with the external surface of the body of the tool, and a contact surface which contacts the rear surface of the cutting blade, again as considered in the direction of rotation of the tool. In this arrangement, the clamping lever is mounted on the body of the tool by means of a hook-shaped end portion which engages behind a correspondingly configurated nose of the support body.

This conventional arrangement is disadvantageous in several respects. First of all, it is susceptible to soiling particularly of the pivotal mounting arrangement for the lever as well as of the sliding guides for the clamping elements. Furthermore, the parts which determine the pivot axis of the lever are very difficult and thus expensive to manufacture. The clamping elements which are guided for movement in the radial direction consume a considerable amount of space as considered in the radial direction, so that high inertial and centrifugal forces are encountered in the arrangement of this type.

On the other hand, there is also already known an annular tool which can be used in a machine for chipping small-size wood, especially wood chops. In the conventional wood-chipping machines of this type, the annular chipping tool includes two axially spaced annular support elements which are interconnected with one another by connecting elements which are located in a plane extending substantially in the axial and approximately radial direction. Under these circumstances, a cutting blade which extends over the axial length of the connecting element is connected to the radially inwardly located marginal portion of the connecting element.

A wood-chipping machine of this type can be found, for instance, in the published German patent application DT-OS No. 1,653,084. In this machine, the cutting blade is clamped between a blade support of rather substantial dimensions, and a clamping plate which has correspondingly huge dimensions and which contacts a front side of the cutting blade. The blade support and the clamping plate are threadedly connected with one another by means of a plurality of screws of high strength and thus are subjected to forces needed for establishing the frictional engagement which retains the cutting blade between the blade support and the clamping plate. The clamping of the blades between the two above-mentioned parts takes place at a location outside the machine. Inasmuch as a plurality of clamping screws is required for each blade packet holding arrangement, which screws have to be respectively tightened in a very careful manner and with a relatively high torque, the mounting or replacement of the cutting blades is very expensive. This, however, is also true about the mounting and dismounting of the blade packet holding arrangement which, in large machines, have correspondingly high length and, because of the necessary substantial dimensions thereof also are possed of a high weight. This blade packet holding arrangement is positioned on a lattice-shaped portion of a dove-shaped configuration which forms a part of the connecting element, and shifted axially of the tool thereon, and then held, by a hydraulic actuating arrangement provided on the connecting element, in the working position. This conventional construction is very expensive as to its structure, and moreover, requires a high amount of time and a high degree of skill for the exchange of the worn-out or damaged cutting blades.

SUMMARY OF THE INVENTION

Accordingly, it is a general object of the present invention to avoid the disadvantages of the prior art.

More particularly, it is an object of the present invention to so construct the tool of the type here under consideration as not to be possessed of the above-mentioned disadvantages.

A further object of the present invention is to design a mounting arrangement for mounting the cutting blades on the rotor of the tool, which is insensitive to soiling and thus provides reliable service even under adverse conditions.

A concomitant object of the present invention is to develop a material-removing tool which is simple in construction, inexpensive to manufacture and assemble, and reliable nevertheless.

Finally, it is an object of the present invention to provide a tool in which cutting blades can be mounted or replaced in the mounting arrangement with a relative ease.

In pursuance of these objects and others which will become apparent hereafter, one feature of the present invention resides, in a material-removing tool, particularly for use in a wood-chipping machine, briefly stated, in a combination which comprises a support having at least one supporting portion; at least one cutting blade; and means for interchangeably connecting the cutting blade to the support, including at least one pressing element having an actuating and a pressing portion, at least one actuator, and means for so mounting the pressing element on the support for pivoting between a releasing and a clamping position that the actuating portion registers with the actuator and the pressing portion is juxtaposed with the supporting portion for clamping the cutting blade between the pressing portion and the supporting portion when the actuator urges the actuating portion and pivots the pressing element into the clamping position, the mounting means being constituted by at least one resilient mounting portion extending between and affixed to the pressing element and the support. It is particularly advantageous when the cutting blade is elongated and when the mounting portion mounts the pressing element for pivoting along a plane substantially normal to the elongation of the cutting blade. This basic concept of the present invention may be very profitably used in a tool the support of which includes a support body having the support portion, a support frame, and means for rotatably mounting the support body on the support frame. According to a further advantageous aspect of the present invention, the pressing element is a lever which has one arm including the pressing portion and another arm including the actuating portion, this other arm being considerably longer than the above-mentioned one arm.

When the material-removing tool is constructed in the above-mentioned manner in accordance with the present invention, it is particularly advantageous that the presence of all sliding surfaces between the parts which move relative to one another is avoided so that the new construction is exceptionally insensitive to soiling and is also inexpensive in manufacture.

According to a further aspect of the present invention, the mounting portion has an enlarged foot zone which is accommodated in a compatibly configurated recess of the support. In many instances, it is advantageous when the mounting portion and the foot zone thereof are of one piece with the pressing element. However, it is also contemplated by the present invention and, in many instances, advantageous when the mounting portion is a component separate from the pressing element. Under these circumstances, it is proposed by the present invention to provide the mounting portion with an enlarged connecting zone which is received in a recess of the pressing element and being retained therein by a connecting element. Under these circumstances, it is especially advantageous when the recess has an undercut configuration. When the pressing element and the mounting portion are constructed as discrete components, it is contemplated to so configurate the mounting portion, together with its foot and connecting zones, as to have either an U-shaped or a Z-shaped cross-section.

The mounting portion holds the pressing element in its desired position. In order to obtain unobjectionable force and stress conditions in the mounting portion, it is advantageous to so arrange the mounting portion as to extend along the direction of a force which results from the action on the pressing element of a force exerted on the actuating portion by the actuator and of a reaction force to that with which the pressing portion presses the cutting blade against the supporting portion of the support.

Advantageously, the actuator includes a compression spring which reacts against the support and acts on the actuating portion of the pressing element to urge the latter toward the clamping position thereof. When, as mentioned above, the cutting blade is elongated, there may be provided at least one additional actuator similar to the above-mentioned actuator and spaced therefrom longitudinally of the cutting blade. Advantageously, the actuator includes a housing and a piston mounted in the housing for reciprocation and connected to the actuating portion, the above-mentioned spring bearing against the piston. It is further advantageous when the piston includes a piston rod which is connected to the actuating portion of the pressing element. When means is provided for reciprocating the piston, especially means for admitting a pressurized medium into the housing to act on the piston, as also proposed by the present invention, there is obtained an additional advantage that the pressing element can be pivoted into its releasing position in which it is possible to exchange the cutting blade for a different one. However, it is also basically possible to provide an additional opening member which tilts the respective pressing element away from the cutting blade when it is desired to release the latter. It is further of advantage when the above-mentioned housing accommodates the spring and is mounted on the support.

When, as mentioned above, the cutting blade is elongated, it is advantageous when both the actuating portion and the pressing portion of the pressing element are arranged over the length of the cutting blade. Under these circumstances, it is advantageous, as proposed by the present invention, when the pressing portion extends continuously over the length of the cutting blade, and when the actuating portion is subdivided into a plurality of actuating zones which are separated from one another at respective locations which are spaced from each other longitudinally of the cutting blade. However, in accordance with an alternative solution to be used in connection with an elongated cutting blade on which the pressing element acts at a predetermined location, it is proposed by the present invention to provide at least one additional pressing element similar to the above-mentioned pressing element and acting on the cutting blade at a different location which is spaced from the above-mentioned location longitudinally of the cutting blade.

The above-mentioned concepts of the present invention can be used to advantage in a tool of the first-mentioned type, that is, in a tool in which the blades extend radially outwardly beyond the periphery of the tool proper. Under these circumstances, it is particularly advantageous, as proposed by the present invention, when the support includes a support member and a support element having the above-mentioned supporting portion and rigidly connected to the support member, the connecting means so connecting the blade to the support element as to form an interchangeable unit therewith. Then, it is further advantageous when the tool includes at least one additional interchangeable unit similar to the above-mentioned unit and rigidly connected to the support member adjacent the above-mentioned unit, advantageously with a spacing therefrom. Under these circumstances, the exposed surfaces of the units may advantageously together form a contact surface of the tool, and it is particularly advantageous when the support element and the pressing element have respective surfaces which together constitute the exposed surface of the respective unit. Then, it is further proposed by the present invention to form the support element with a chip-receiving depression at the exposed surface adjacent the cutting blade.

A particular advantage of the construction which has been described just above, is to be seen in the fact that the support member does not form the external or contact surface of the tool at any location. In other words, the support member serves merely as a carrier for the interchangeable units which, when damaged to a substantial degree can be substituted on location by a new unit of the same type. No damage can occur to the support member any longer so that the otherwise needed costly reworking of the support member can be dispensed with. Inasmuch as the units are arranged at a spacing from one another, even though the spacing is rather minute, these components will not constitute any closed and rigid jacket. Rather, each unit constitutes a separate entity, and the spacing between the units permits slight dimensional and positional changes while avoiding transmission of pressing and bending forces between the units.

Because of the position of the lever arms of the pressing lever and the selected force-transmission ratio, there is obtained a relatively small radial dimension for the tool of the present invention. What is most important is, however, that all sliding surfaces between relatively movable components are avoided, so that the new construction is very insensitive to soiling and the production cost of this arrangement is very low. The partial surfaces which together constitute the contact surface of the tool remain immovable in the radial direction so that there is obtained a vibration-free contact with the material or article to be worked upon and, as a consequence thereof, there are obtained exact and uniform thicknesses of the chips and a reduced wear of the parts which together form the contact surface. Simultaneously therewith, those parts forming the contact surface of the tool which are located directly before and behind the cutting blades as considered in the direction of rotation of the tool, which are subjected to wear to a considerable degree, can be easily exchanged so that the required repair or restoration operations can be performed on location in an easy manner and in a short period of time.

This is particularly true when, as also proposed by the present invention, the support element includes a basic body and an abutment body rigidly connected to the basic body and constituting the supporting portion of the support element. Then, each of the bodies advantageously partially bounds the chip-receiving depression. It is also very advantageous, in accordance with the present invention, when the enlarged foot zone of the mounting portion is rigidly connected to the abutment body, particularly when each of the bodies has an undercut recess and the foot zone of the mounting portion is received in the undercut recesses thereof and between the bodies.

It is particularly advantageous when the actuator is mounted exclusively on the support element and forms a part of the interchangeable unit. In this manner, it is assured that the actuator will always properly register with the actuating portion of the pressing element, without any need for positional adjustment during the exchange of the blade of or the unit. Then, it is advantageous when means is provided for pivoting the pressing member toward the releasing position thereof for releasing the cutting blade.

On the other hand, when the basic concept of the present invention is to be used in the second one of the mentioned tools, it is advantageous to so construct the support as to include a support frame, at least two annular support elements which are mounted on the support frame for rotation about an axis and are axially spaced from one another, and at least one connecting element interconnecting the support elements, extending substantially parallel to the axis, and having at least one recess, the mounting portion having an enlarged foot zone which is received and fixed in the recess. In this construction, it is particularly advantageous when the connecting element includes a connecting member, and at least one support body rigidly and interchangeably mounted on the connecting member to which the foot zone of the mounting portion is affixed.

A most important advantage of the tool constructed in this manner is to be seen in the fact that the components which are to generate the high clamping force needed for clamping the cutting blade and which, consequently, have to have substantial dimensions, are provided directly on the support and thus no longer need be manually handled. The cumbersome clamping of the cutting blade in the blade packet outwardly of the machine is fully avoided. The actuators which act on the pressing element replace, on the one hand, the clamping screws which have heretofore assured the frictional retention of the cutting blade, as well as, on the other hand, the hydraulic arrangement which has heretofore been employed for holding the blade packet in the tool. In addition thereto there is now provided the possibility to release the cutting blades by simply pivoting the pressing element oppositely to the action of the actuators thereon and thus to replace the respective blade, in a simple manner, by a new cutting blade. It will be appreciated that the new construction can be used in conjunction with both sharpenable cutting blades as well as with disposable cutting blades.

It is particularly advantageous when a protective member of elastic material is provided which is interposed between the connecting element and the pressing member intermediate the actuator and the mounting portion. In this manner, the components of the arrangement which are situated about the mounting portion are protected from soiling.

Finally, it is very advantageous when the connecting element includes a connecting member and at least one support body rigidly and interchangeably mounted on the connecting member and constituting the supporting portion. Under these circumstances, the support body, which is subjected to an increased wear, can be easily replaced whenever needed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
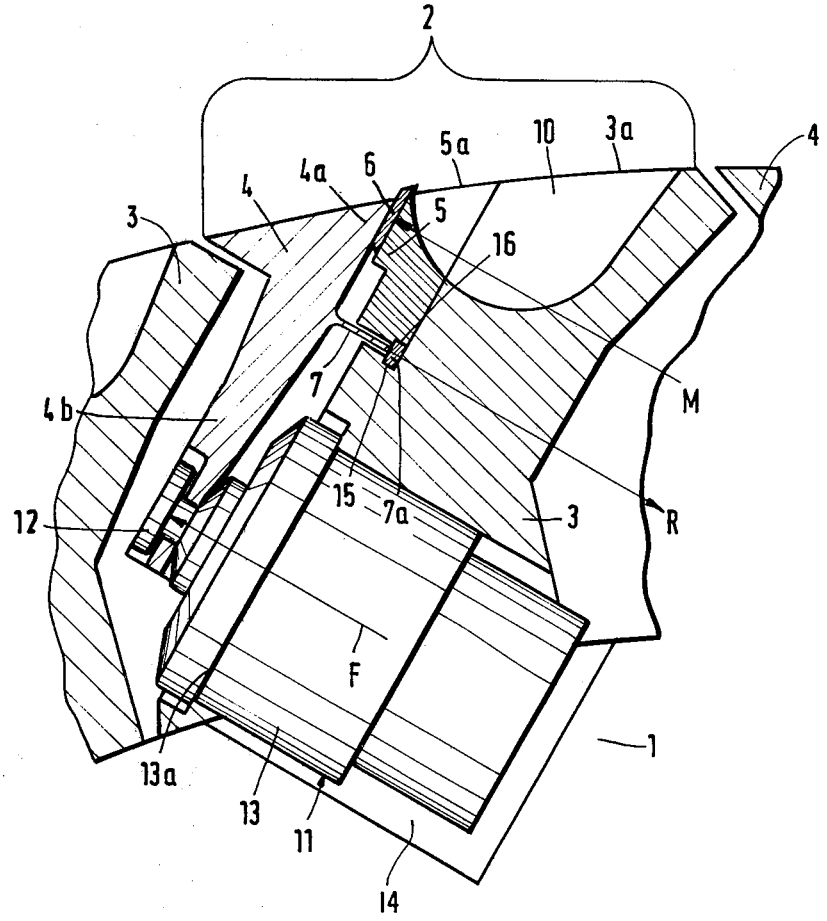
FIG. 1 is a cross-sectional view of a fragment of a tool embodying the present invention.

Referring now to the drawings in general, it is to be mentioned that they disclose several embodiments of the basic concept of the present invention which are so similar to one another that, as far as feasible, the corresponding parts or portions have been designated with the same reference numerals throughout. It may also be advantageous to mention, at the outset, that the basic concept of the present invention can be used in a variety of material-removing tools, particularly in the wood-chipping tools shown in the drawings. When speaking of wood-chipping tools, it is to be understood that what is meant is such tools which remove chips from articles to be finished or otherwise worked upon, or shred otherwise waste pieces of wood into chips or similar particles.

Referring now more particularly to FIG. 1, it may be seen that it illustrates a rotary cutting tool which includes a basic body 1 having an external surface on which there is mounted a plurality of interchangeable units 2 of which only one unit 2 is completely illustrated in the drawing, whereas only small portions of the adjacent units are shown spaced by small gaps from the fully illustrated unit. The units 2 are arranged next to one another with spacing therebetween and, together, they form an external exposed contact surface of the cutting tool. In order not to unduly encumber the drawings, the means for connecting the units 2 to the basic body 1, which may include, for instance, conventional keys and screws, have not been illustrated. Each of the blade-carrying units 2 is constructed as a separate structural unit and includes a carrier 3, a pressing element 4, a support element 5, as well as actuators 11 which act on the pressing element 4. A respective cutting blade 6 is held in each of the blade-carrying units 2 exclusively by friction.

The carrier 3 or abutment body has a radially inwardly facing surface which contacts the basic body 1, and a radially outwardly located surface 3*a* which forms a part of the contact surface of the tool.

The pressing element 4 presses against the rear side of the cutting blade 6, as considered in the direction of rotation of the tool, and is constructed as a two-armed lever whose one arm 4*b*, which is acted upon by the actuators 11, is located radially inwardly and is longer than a lever arm 4*a* which is located radially outwardly and which acts on the cutting blade 6 and, in addition thereto, forms a part of the contact surface of the tool.

The mounting arrangement for the pressing element 4 includes a resilient portion or member 7 which is connected, at one of its ends, to the pressing element 4 and, at its other end, to the carrier 3 so as to mount the pressing element 4 for pivoting movement between a cutting blade releasing position and a clamping position.

The support element 5 is affixed to the carrier 3 and has a surface 5*a* which forms a part of the exposed external contact surface of the tool. The support element 5 further has a supporting surface against which the front side of the cutting blade 6, as considered in the direction of rotation of the tool, abuts. Chip-receiving depressions or pockets 10 are provided in the respective carriers 3 and in the respective support elements 5.

The actuators 11 include pistons which are acted upon by springs, the pistons having respective piston rod portions 12 which are attached to the radially inwardly located lever arms 4*a* of the respective levers 4. The actuators 11 further include respective housings 13 which accommodate the respective pistons and springs. The housing 13 has an annular flange 13*a* which bears against the carrier 3. The housing 13 further has a radially inwardly located end which is received in a depression 14 of the basic body 1. Thus, the reaction forces to the forces exerted by the actuator on the pressing element 4 are transmitted via the annular flange 13*a* exclusively into the carrier 3.

As already mentioned previously, the tools illustrated at least in FIGS. 1 to 3 are very similar to one another. Thus, the only substantial difference between these three tools is to be found in the construction, location and attachment of the mounting portion or element 7. Accordingly, in FIG. 1, the end of the mounting portion 7 which is to be connected to the carrier 3 is provided with an enlarged foot zone 7*a* which is connected to the carrier 3 by being received therein in respective recesses 15 of the carrier 3 and 16 of the support element 5. The recesses 15 and 16 are so configurated that a portion of the carrier 3 or of the support element 5 overlaps the enlarged foot zone 7*a* of the mounting portion 7 generally in the radial direction. In FIG. 1, the pressing element 4, the resilient mounting portion 7 and the foot zone 7*a* of the latter are of one-piece with one another.

Figure 2:
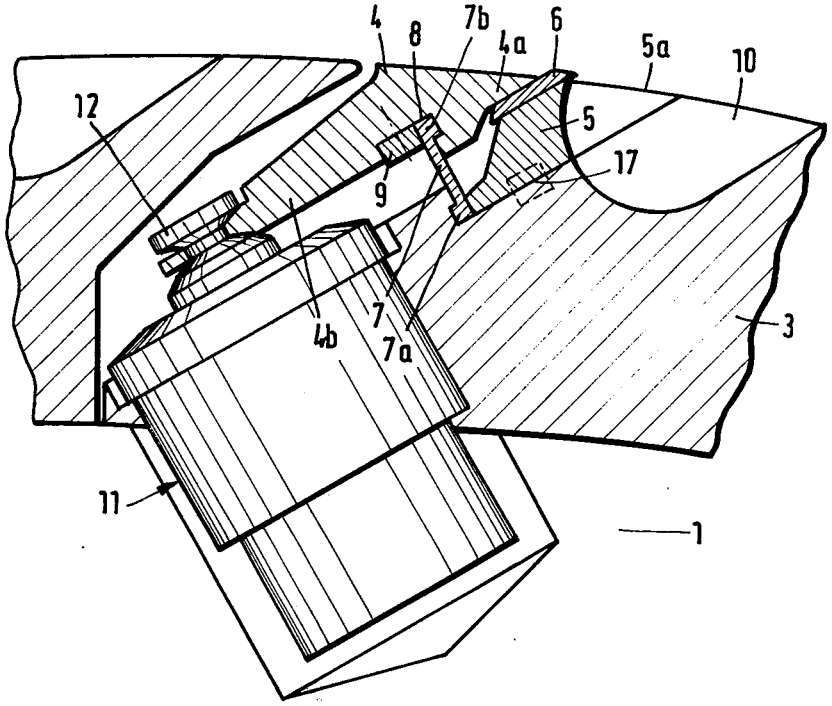
FIG. 2 is a view similar to FIG. 1 but illustrating a modification.

In the modification illustrated in FIG. 2, the end of the mounting portion 7 which is to be connected to the pressing element 4 is formed with an enlarged connecting zone 7*b* which is received in an undercut recess 8 of the pressing element 4 and is retained therein by means of a closing piece 9 which is fixed by means of screws or the like. In this arrangement, the resilient mounting portion 7 has a substantially Z-shaped cross-section.

Figure 3:
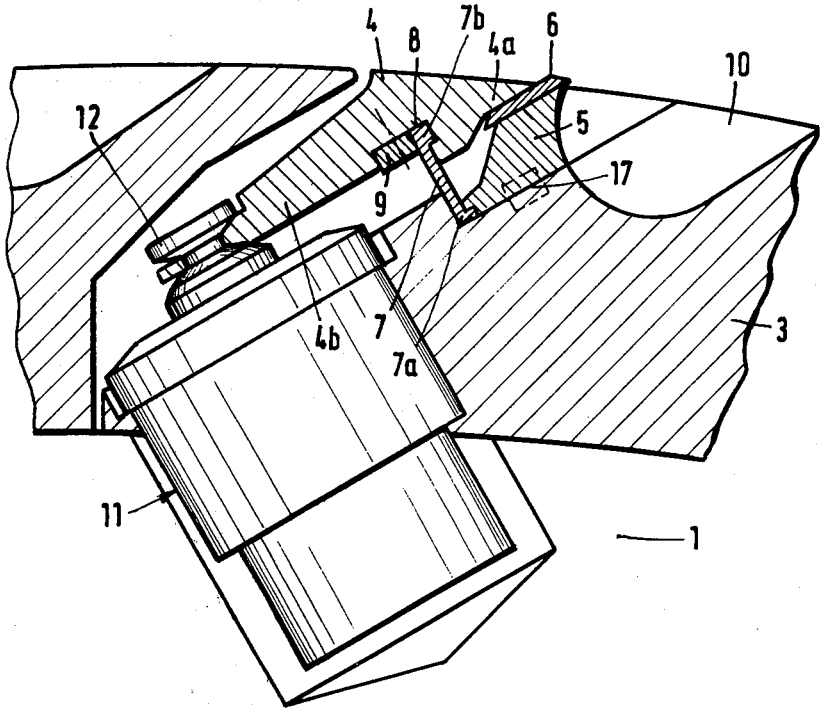
FIG. 3 is a view similar to FIGS. 1 and 2 but illustrating a further modification.

FIG. 3 illustrates a different resilient mounting portion 7 which also has the enlarged connecting zone 7*b* which is connected to the pressing element 4 and the foot zone 7*a* which is connected to the carrier 3. However, these zones 7*a* and 7*b*, together with the remainder of the resilient mounting portions 7, have a generally U-shaped cross-section. The foot zone 7*a* is received in an undercut recess of the support element 5. The support element 5 is rigidly connected to the carrier 3 by one or more keys 17 and also by non-illustrated conventional screws.

As may be seen particularly in FIG. 1, the mounting portion 7 is located along a resulting force R, which results from the blade-pressing force M as well as from the force component F of the actuators 11.

Figure 4:
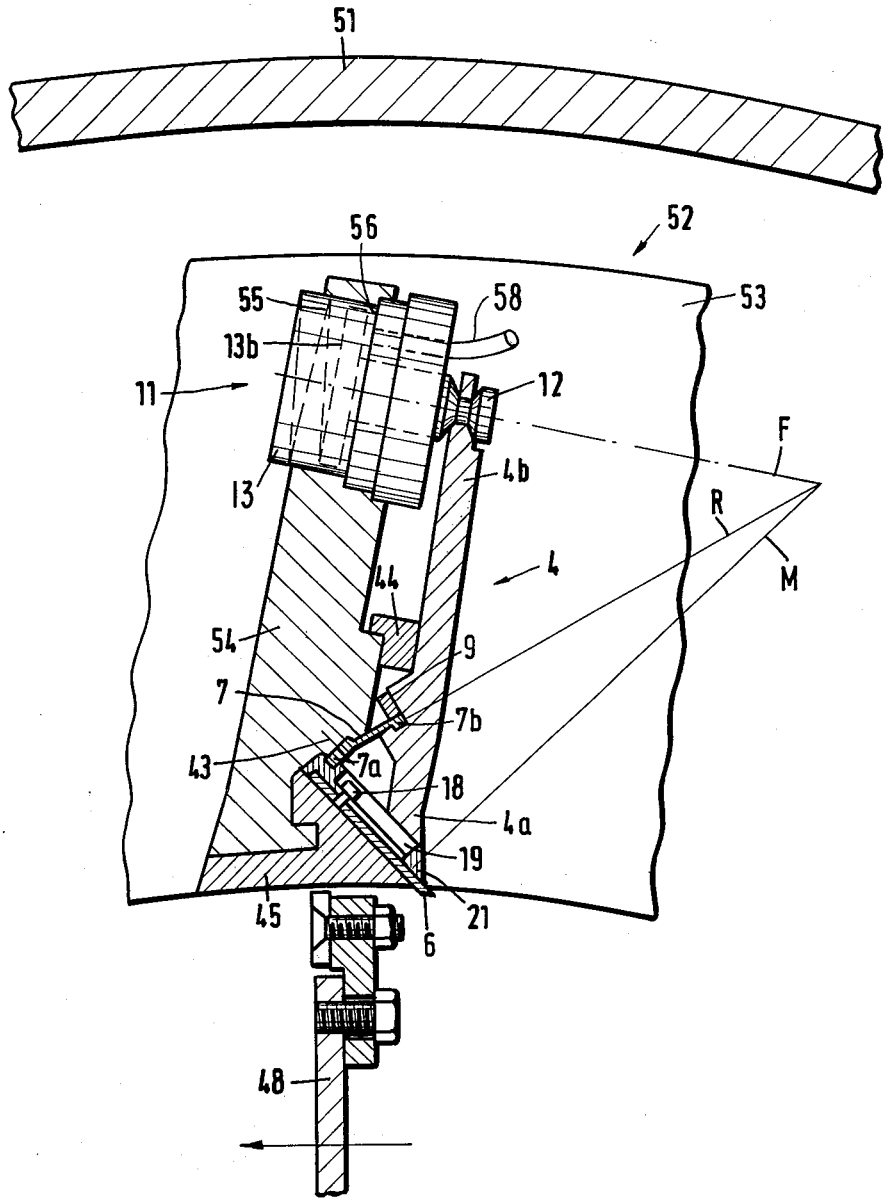
FIG. 4 is a view similar to FIGS. 1 to 3, but revealing how the present invention is embodied in a different tool.

The annular tool which is illustrated in FIG. 4 includes a machine housing 51 and a support body 52 of an annular configuration which is mounted therein for rotation. The annular body 52 includes two annular support members support elements 53 which are located at an axial distance from one another and of which only the rear support member is shown, the annular members 53 being interconnected by means of connecting elements 54 which extend approximately in the radial direction of the support member 52. A cutting blade 6, which may be of the re-sharpenable type, is connected to the respective radially inwardly located marginal portion of the respective connecting element 54, the cutting blade 6 extending over the axial length of the connecting element 54. This cutting blade 6 is connected, for instance, by screws, to a customary carrier 21, advantageously, at the exterior of the machine. However, the mounting of the cutting blade 6 on the carrier 21 is performed for the single purpose of adjusting the degree to which the cutting blade 6 will eventually extend inwardly into the space surrounded by the annular support members 53. In this condition, the respective cutting blade 6 is then introduced into the support body 52. The connection between the cutting blade 6 and the carrier 21 is accomplished by means of at least one screw 18 which is guided, in a conventional manner, in an elongated slot 19 of the carrier 21 for shifting therein and thus serves only the purpose of establishing a temporary clamping connection between the cutting blade 6 and the carrier 21.

The actual frictional retention of the cutting blade 6 is accomplished by means of the two-armed lever 4, the shorter lever arm **4*a* of which presses against the carrier 21, while the relatively longer lever arm 4*b* is subjected to the force of a compression spring 55 which presses the pressing element or lever 4 towards and into its clamping position. The spring 55 accommodated in the pressure cylinder 13 and acts on the pressure piston 13*b* which is mounted in the interior of the cylinder 13 for reciprocation and which has piston rod portion 12 that is connected with the longer lever 4*b* of the pressing element 4. The spring 55, the pressure piston 13*b* and the cylindrical housing 13 respectively form together the respective actuator 11 which is accommodated within the connecting element 54. The piston 13*b* may be moved in opposition to the spring 55 by admitting pressure fluid through a tube 58 into the cylinder 13 against the face of the piston 13*b* which is opposite the face engaged by the spring 55**.

Even in this somewhat different tool, like in the tools discussed previously in connection FIGS. 1 to 3, the pivot axis of the pressing element, which extends parallel to the axis of rotation of the support body 52 or parallel to the longitudinal axis of the respective cutting blades 6, is constituted by the resilient mounting portion 7 which, at one of its ends, is connected to the pressing element 4 and, at its other end, is affixed to the connecting element 54. The end of the mounting portion 7 which is to be connected to the connecting element 54 is provided with an enlarged foot zone **7*a* which is received in a compatibly configurated recess of the connecting element 54 and is held therein by means of a screw 43. The other end of the resilient mounting portion 7 is provided with a connecting zone 7*b* which is also enlarged and which is received in a compatibly configurated undercut recess of the pressing element 4 and retained therein by means of a connecting piece 9 which is held in position by screws or the like. Even here, the arrangement is such that the mounting portion 7 extends in direction of the resulting force R which results from the blade-pressing force M as well as the force component F of the actuator 11**.

The foot zone **7*a* is rigidly connected to the carrier 21. It is to be understood that a disposable cutting blade could be used instead of the re-sharpenable cutting blade 6. Under these circumstances, a support element could be arranged between the pressing element 4 and the cutting blade 6, and the foot 7*a* of the resilient mounting portion 7** would then be rigidly connected to this support element.

The interspace between the pressing element 4 and the connecting element 54 is closed by a profiled protective element 44 of an elastic material at a location intermediate the mounting portion 7 and the actuator 11. The radially inwardly located portion of the connecting element 54 is constituted by an exchangeable support element 45 against which the cutting blade 6 abuts.

FIG. 4 further illustrates a wing 48 of an impacting wheel which, in a conventional manner, can rotate in the same direction as the tool 52 but at a higher angular speed, or could rotate in a direction opposite to the tool 52, or could be stationary. What is important is that there always be a relative movement between the tool 52 and the wing 48.

Figure 5:
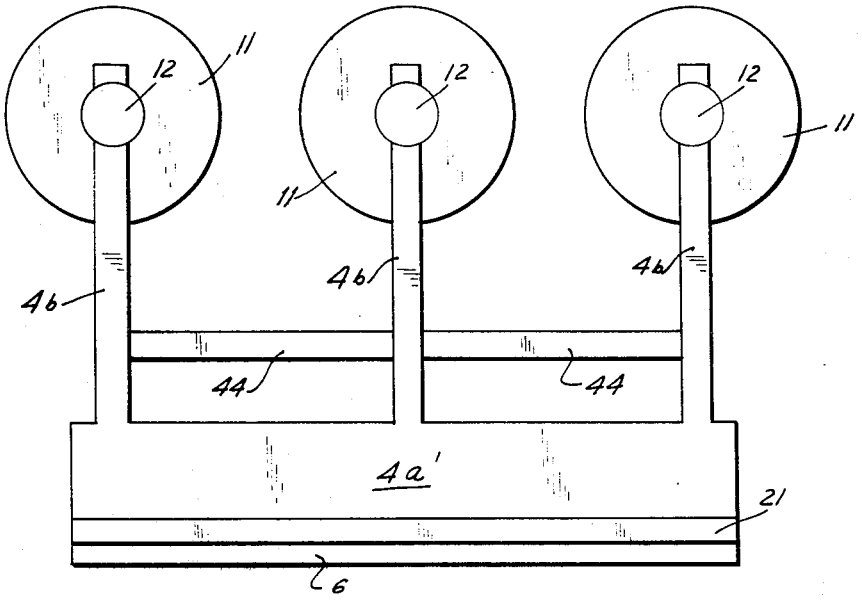
FIGS. 5 and 6 are schematic top view of modified tools according to the present invention and having an elongated cutting blade.
Figure 6:
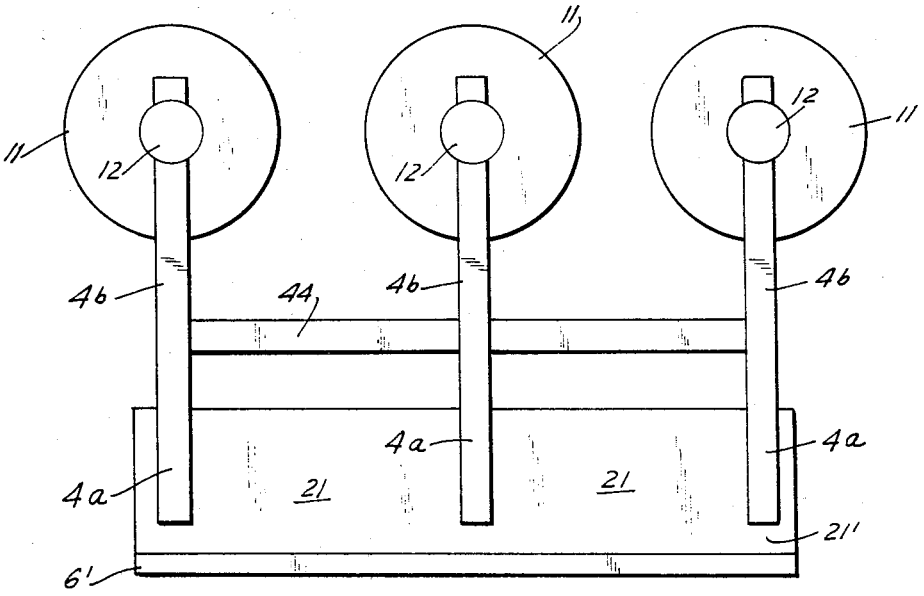

FIGS. 5 and 6 schematically illustrate top views of material removing tools in which the cutting blade 6' is of considerable length. In these embodiments there are three actuators 11 provided for each cutting blade, spaced in the longitudinal direction of the blade from each other and the piston rod portions 12 of the three actuators 11 respectively engage the longer arms **4*b* of the pressing element adjacent one end. In the embodiment shown in FIG. 5, the other ends of the longer arms 4*b* are fixedly connected to an elongated member 4*a*' constituting the shorter arm of the pressing element, which elongated member extends over the whole length of the carrier 21', which in turn extends over the whole length of the cutting knife 6'. The embodiment shown in FIG. 6 differs from that shown in FIG. 5 in that the three shorter arms 4*a* are not combined into a single element, but each of which forms the continuation of the respective longer arm 4*b* and presses with its free end against transversely spaced portions of the elongated carrier 21. For simplification reason the resilient portion 7 of the pressing element is not shown in these Figures and the support 3, 5** is likewise omitted therefrom for simplification reason.

It will be understood that each of the elements described above, or two or more together, may also find a useful application in other types of constructions differing from the types described above.

While the invention has been illustrated and described as embodied in a tool for use in wood-chipping machines it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a material-removing tool, particularly in a wood chipping machine, a combination comprising a support having at least one supporting portion; at least one cutting blade; and means for interchangeably connecting said cutting blade to said support, including at least one actuator and at least one pressing element having an actuating portion engaged by said actuator and a pressing portion juxtaposed with said supporting portion, and resilient mounting means extending between and being affixed to said pressing element and said support and mounting said pressing element on said support for pivoting between a releasing and a clamping position for clamping said cutting blade between said pressing portion and said supporting portion when said actuator urges said pressing portion toward said support.

2. A combination as defined in claim 1, wherein said cutting blade is elongated; and wherein said mounting portion mounts said pressing element for pivoting along a plane substantially normal to the elongation of said cutting blade.

3. A combination as defined in claim 1, wherein said pressing element is a lever having one arm including said pressing portion and another arm including said actuating portion; and wherein said other arm is considerably longer than said one arm.

4. A combination as defined in claim 1, wherein said mounting portion has an enlarged foot zone; and wherein said support has a recess compatibly configurated to and accommodating said foot zone of said mounting portion.

5. A combination as defined in claim 4, wherein said mounting portion and said foot zone thereof are of one piece with said pressing element.

6. A combination as defined in claim 1, wherein said mounting portion has an enlarged connecting zone; wherein said pressing element has a recess for receiving said connecting zone; and further comprising a connecting element retaining said connecting zone in said recess.

7. A combination as defined in claim 6, wherein said recess has an undercut configuration.

8. A combination as defined in claim 1, wherein said mounting portion is so situated as to extend along the direction of a force which results from the action on said pressing element of a force exerted on said actuating portion by said actuator and of a reaction force to that with which said pressing portion presses said cutting blade against said supporting portion of said support.

9. A combination as defined in claim 1, wherein said actuator includes a compression spring which reacts against said support and acts on said actuating portion of said pressing element to urge the latter toward said clamping position thereof.

10. A combination as defined in claim 9; wherein said cutting blade is elongated; and further comprising at least one additional actuator similar to said actuator and spaced therefrom longitudinally of said cutting blade.

11. A combination as defined in claim 9, wherein said actuator includes a housing and a piston mounted on said housing for reciprocation and connected to said actuating portion; and wherein said spring bears against said piston.

12. A combination as defined in claim 11, wherein said piston includes a piston rod which is connected to said actuating portion.

13. A combination as defined in claim 11; and further comprising means for reciprocating said piston, including means for admitting a pressurized medium into said housing to act on said piston.

14. A combination as defined in claim 11; wherein said housing accommodates said spring and is mounted on said support.

15. A combination as defined in claim 1, wherein said cutting blade is elongated; and wherein both said actuating portion and said pressing portion extend over a length equal to that of said cutting blade.

16. A combination as defined in claim 15, wherein said actuating portion is subdivided into a plurality of actuating zones which are separated from one another at respective locations which are spaced from each other longitudinally of said cutting blade.

17. A combination as defined in claim 1, wherein said pressing portion extends continuously over the length of said cutting blade.

18. A combination as defined in claim 1; and further comprising means for pivoting said pressing member toward said releasing position thereof for releasing said cutting blade.

19. A combination as defined in claim 1, wherein said support includes two annular support elements rotatable about a central axis and which are axially spaced from one another, and at least one connecting element interconnecting said support elements, extending substantially parallel to said axis, and having at least one recess; and wherein said mounting portion has an enlarged foot zone received and fixed in said recess.

20. A combination as defined in claim 19, wherein said connecting element includes a connecting member and at least one support body rigidly and interchangeably mounted on said connecting member; and wherein said foot zone is affixed to said support body.

21. A combination as defined in claim 19; and further comprising a protective member of elastic material interposed between said connecting element and said pressing element intermediate said actuator and said mounting portion.

22. A combination as defined in claim 19, wherein said connecting element includes a connecting member and at least one support body rigidly and interchangeably mounted on said connecting member and constituting said supporting portion.

23. A combination as defined in claim 1, wherein said resilient mounting means is located in a plane coinciding with the direction of force which is the resultant of the force with which said actuator acts against said actuating portion and the reaction force with which said pressing portion presses said cutting blade against said support portion.

24. A combination as defined in claim 1, wherein said cutting blade is elongated, and wherein said connecting means includes a plurality of pressing elements acting on said cutting blade at different locations which are spaced from each other longitudinally of said cutting blade.

25. A combination as defined in claim 1 and including a basic body, and wherein said support, said cutting blade and said connecting means form an interchangeable unit mounted on said basic body.

26. A combination as defined in claim 25, wherein said actuator is mounted exclusively on said support and forms a part of said interchangeable unit.

27. A combination as defined in claim 25, wherein a plurality of such units are mounted on said basic body.

28. A combination as defined in claim 27, wherein said units are spaced from one another.

29. A combination as defined in claim 28, wherein said support and said pressing element have respective surfaces which together constitute said exposed surface of the respective unit.

30. A combination as defined in claim 27, wherein said units have respective exposed surfaces which together form a contact surface of the tool.

31. A combination as defined in claim 30, wherein said support has a chip-receiving depression at said exposed surface adjacent said cutting blade.

32. A combination as defined in claim 31, wherein each of said elements partially bounds said chip-receiving depression.

33. A combination as defined in claim 3, wherein said support includes a support element having said supporting portion and a carrier element abutting against said support element on a side thereof spaced from said supporting portion.

34. A combination as defined in claim 33, wherein said mounting portion has an enlarged foot zone which is rigidly connected to said abutment body.

35. A combination as defined in claim 34, wherein each of said elements has an undercut recess; and wherein said foot zone of said mounting portion is received in said recesses and between said elements.

* * * * *